US006766539B1

(12) United States Patent
Huber

(10) Patent No.: US 6,766,539 B1
(45) Date of Patent: Jul. 27, 2004

(54) FOOT LINER

(76) Inventor: Thomas Huber, 3 Wicket St., Coram, NY (US) 11727

( * ) Notice: Subject to any disclaimer, the term of this patent is extended or adjusted under 35 U.S.C. 154(b) by 0 days.

(21) Appl. No.: 10/413,717

(22) Filed: Apr. 15, 2003

(51) Int. Cl.[7] ..... A43B 17/08
(52) U.S. Cl. ..... 2/239; 2/DIG. 1
(58) Field of Search ..... 2/239, 240, 241, 2/242, 409, 245, 267, DIG. 1; D2/919, 961; 66/171, 177

(56) References Cited

U.S. PATENT DOCUMENTS 832,550 A * 10/1906 Lepper ..... 2/61
1,597,934 A * 8/1926 Stimpson ..... 36/3 A
2,248,303 A * 7/1941 Morgenroth et al. ..... 2/239
2,596,211 A * 5/1952 Comfort ..... 2/240
3,148,378 A * 9/1964 Tibbitts ..... 2/239
3,212,103 A * 10/1965 Goodman ..... 2/409
3,882,868 A * 5/1975 Tundermann ..... 604/293
4,126,903 A * 11/1978 Horton ..... 2/409
4,155,123 A * 5/1979 Popper ..... 2/239
4,186,499 A * 2/1980 Massok et al. ..... 36/44
4,206,514 A * 6/1980 Yamauchi ..... 2/239
4,228,549 A * 10/1980 Rispoli ..... 2/239
5,682,617 A * 11/1997 Tumas ..... 2/239
5,737,776 A * 4/1998 Jennings ..... 2/409
5,768,713 A * 6/1998 Crick ..... 2/409
6,038,726 A * 3/2000 Kelly et al. ..... 15/227
6,173,589 B1 * 1/2001 Hayes et al. ..... 66/171
6,247,182 B1 * 6/2001 Tasbas ..... 2/239
6,334,222 B1 * 1/2002 Sun ..... 2/239
6,336,227 B1 * 1/2002 Liput et al. ..... 2/239
6,351,852 B1 * 3/2002 Propp ..... 2/174
6,367,087 B1 * 4/2002 Spillman et al. ..... 2/239
6,430,771 B2 * 8/2002 Ahern ..... 15/118
6,446,267 B1 * 9/2002 Shah ..... 2/239
6,593,371 B1 * 7/2003 Staggs ..... 514/627

* cited by examiner

*Primary Examiner*—John J. Calvert
*Assistant Examiner*—Alissa L. Hoey

(57) ABSTRACT

A foot liner comprising an insert positioned within the interior of a shoe, an exterior, a fastener and a bottom liner. The invention may also include deodorizer, talc and/or medicated athletes foot powder. The absorption and neutralization of odors, which may be associated with perspiration of the foot, are also achieved. The use of this product could reduce embarrassment associated with removing one's shoes while also providing individuals with enhanced comfort. The foot liner would also allow individuals to various articles of footwear without the need for socks.

1 Claim, 3 Drawing Sheets

FOOT LINER

BACKGROUND OF THE INVENTION

1. Field of the Invention

The present invention relates to a foot liner for use in connection with eliminating foot odor. The foot liner has particular utility in connection with absorbent bottom layer that contains deodorizer, talc and/or medicated athletes' foot powder.

2. Description of the Prior Art

Foot liners are desirable as a means to keep feet and shoes odor free and dry.

The use of stocking devises is known in the prior art. For example, U.S. Pat. No. 6,247,182 B1 to Tasbas discloses a foot protector, which is comprised of at least about 80 weight percent of a fabric material. The fabric material is comprised of at least 50 weight percent of stretch fabric, it is made from a two sheets of fabric, and a space between the two sheets of fabric is adapted to receive volatilizable material. A hole extends through the first sheet of fabric, and the hole has a diameter of less than about 0.3 inches. A volatilizable material is disposed within the space disposed between the two sheets of fabric. However, the Tasbas '182 patent does not have an absorbent bottom layer that contains deodorizer, talc and/or medicated athletes' foot powder, and has further drawbacks of having two layers of fabric, while the present invention only has one layer making it far less cumbersome. U.S. Pat. No. 4,228,549 to Rispoli discloses a foot deodorizer comprising socks or stockings are woven of a synthetic resin yam in which activated charcoal is present in powder and small particle form in sufficient quantities to deodorize foot odors that may be present when the socks or stockings are worn.

However, the Rispoli '549 patent does not have a mesh-like exterior that would be hidden by the shoe, and additionally does not have an absorbent bottom layer that contains deodorizer, talc and/or medicated athletes' foot powder. Similarly, U.S. Pat. No. 4,151,660 to Yoshimi discloses a sock for use with footgear is provided comprising a core formed of copper or copper-containing metal, a top ply of air-permeable material overlying the upper surface of said core, and a bottom ply of air-permeable material underlying the lower surface of the core, at least said top ply and bottom ply being joined together around the periphery of said core. The socks according to this invention maintain user's feet sanitary in his footgear for a period of time and keep his feet from giving off offensive odors.

However, the Yoshimi '660 patent does not absorbent bottom layer that contains deodorizer, talc and/or medicated athletes' foot powder. and can not cost-effectively be removed from the foot, discarded, and replaced after every use like the present invention.

Therefore, a need exists for a new and improved foot liner that can be used for keeping the feet and shoes dry and odor free. In this regard, the present invention substantially fulfills this need. In this respect, the foot liner according to the present invention substantially departs from the conventional concepts and designs of the prior art, and in doing so provides an apparatus primarily developed for the purpose of keeping the feet and shoes dry and odor free.

SUMMARY OF THE INVENTION

In view of the foregoing disadvantages inherent in the known types of stocking devises now present in the prior art, the present invention provides an improved foot liner, and overcomes the above-mentioned disadvantages and drawbacks of the prior art. As such, the general purpose of the present invention, which will be described subsequently in greater detail, is to provide a new and improved foot liner which has all the advantages of the prior art mentioned heretofore and many novel features that result in a foot liner which is not anticipated, rendered obvious, suggested, or even implied by the prior art, either alone or in any combination thereof.

To attain this, the present invention essentially comprises a foot liner comprising an insert positioned within the interior of a shoe, an exterior, a fastener and a bottom liner.

There has thus been outlined, rather broadly, the more important features of the invention in order that the detailed description thereof that follows may be better understood and in order that the present contribution to the art may be better appreciated.

The invention may also include deodorizer; talc and/or medicated athletes foot powder. There are, of course, additional features of the invention that will be described hereinafter and which will form the subject matter of the claims attached.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. In this respect, before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved foot liner that has all of the advantages of the prior art stocking devices and none of the disadvantages.

It is another object of the present invention to provide a new and improved foot liner that may be easily and efficiently manufactured and marketed.

An even further object of the present invention is to provide a new and improved foot liner that has a low cost of manufacture with regard to both materials and labor, and which accordingly is then susceptible of low prices of sale to the consuming public, thereby making such foot liner economically available to the buying public.

Still another object of the present invention is to provide a new foot liner that provides in the apparatuses and methods of the prior art some of the advantages thereof, while simultaneously overcoming some of the disadvantages normally associated therewith.

Even still another object of the present invention is to provide a foot liner for the absorption and neutralization of odors, which may be associated with perspiration of the foot. The use of this product could reduce embarrassment associated with removing one's shoes while also providing individuals with enhanced comfort. The foot liner would also allow individuals to various articles of footwear without the need for socks.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various figures.

DESCRIPTION OF THE PREFERRED EMBODIMENT

Figure 1:
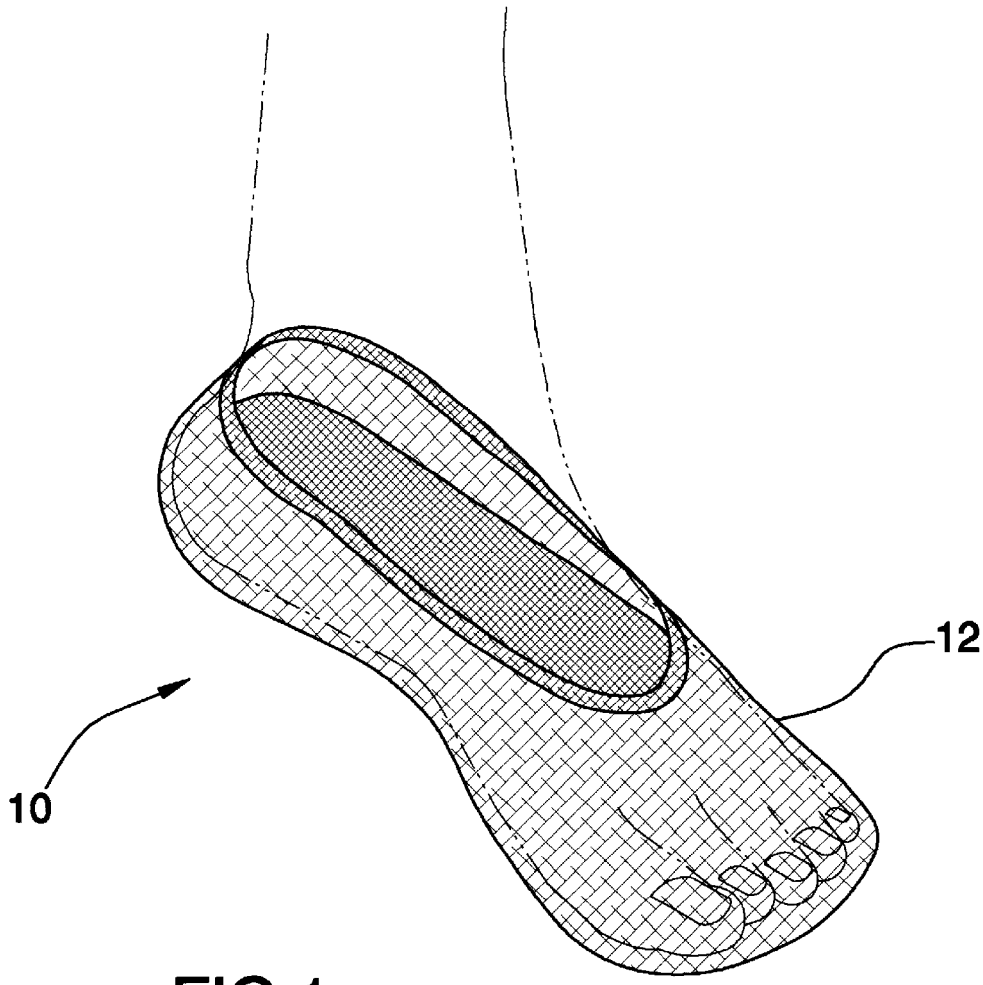
FIG. 1 is a perspective view of the preferred embodiment of the foot liner constructed in accordance with the principles of the present invention.

Referring now to the drawings, and particularly to FIGS. 1–4, a preferred embodiment of the foot liner of the present invention is shown and generally designated by the reference numeral 10.

In FIG. 1, a new and improved foot liner 10 of the present invention for the lining of feet for improved comfort and other benefits is illustrated and will be described. More particularly, the foot liner 10 has a flexible mesh exterior 12 that is formed generally into the shape of a foot. The flexible mesh 12 may optionally contain deodorizers, and has an opening through which a foot may be inserted into the foot liner.

Figure 2:
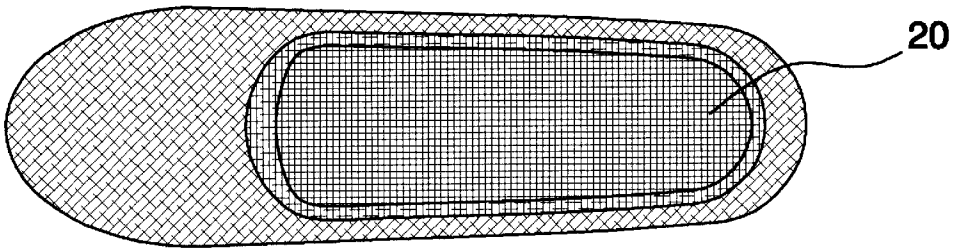
FIG. 2 is a top view of the foot liner of the present invention.

FIG. 2 is a top view of the foot liner 10. In FIG. 2, an bottom liner 20 is shown through the foot insertion opening of the flexible mesh. In the preferred embodiment, the bottom liner is comprised of an absorbent, paper-like cotton material.

Figure 3:
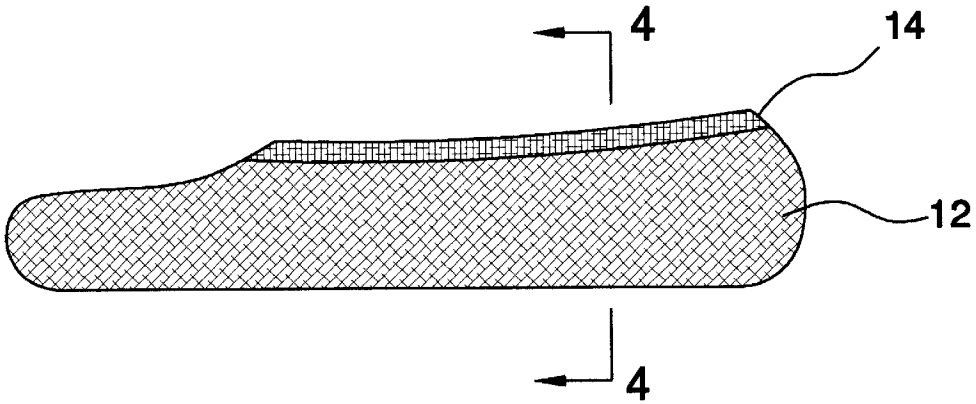
FIG. 3 is a side view of the foot liner of the present invention.

Turning to FIG. 3, a side view of the foot liner is shown. The opening of the flexible mesh 12 is shown to be a fastener 14. While any type of fastener suitable to retaining the foot liner on an inserted foot, in the preferred embodiment, the fastener 14 is a band that rings the opening of the flexible mesh 12. More particularly, the specific fastener employed is a lightweight, elastic band.

Figure 4:
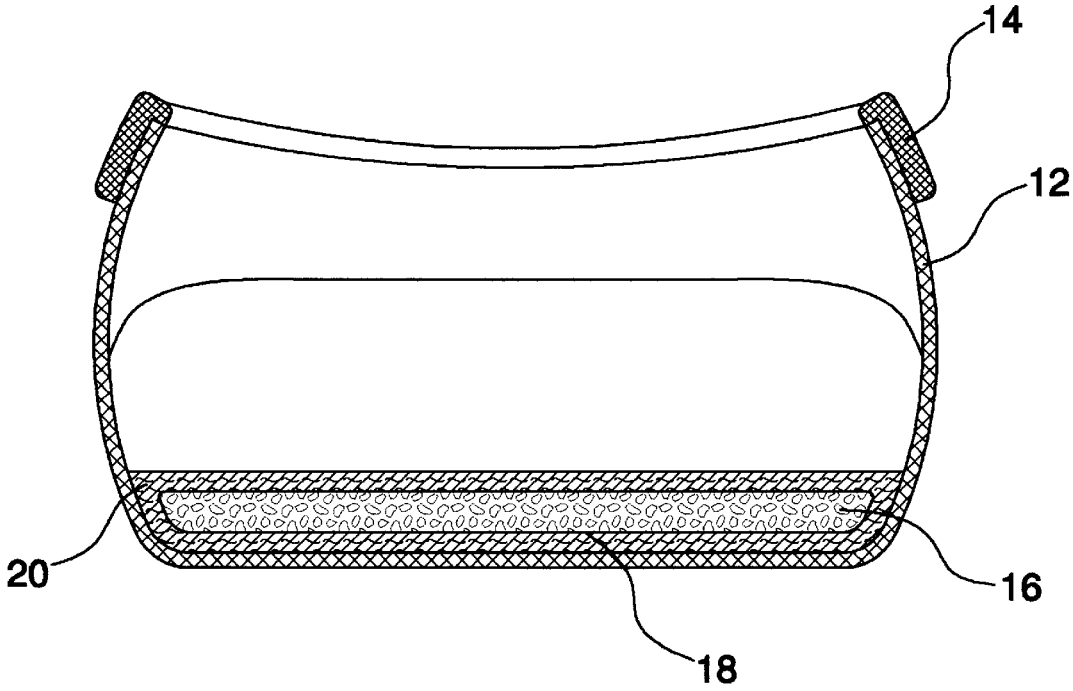
FIG. 4 is a cross-section view of the foot liner of the present invention.

FIG. 4 shows a cross-section of the foot liner. An elastic band 14 is shown to be attached to flexible mesh 12 so as to rim the opening of the flexible mesh 12. Furthermore, a bottom liner 20 is shown (also shown from an overview in FIG. 2). The bottom liner 20 of the preferred embodiment is absorbent. Bottom liner 20 may be any composition suitable to provide improved comfort, durability, or other benefit to the liner as a whole. In the preferred embodiment, the specific bottom liner employed includes a paper-like outer layer 18 and a deodorizer and talc inner core 16.

In use, it can now be understood that the foot liner of the present invention provides improved comfort and odor control benefits. Furthermore, the foot liner of the present invention would obviously provide a less expensive foot liner than foot liners typically found on the market. In fact, the cost of the foot liner of the present invention would be so much less expensive than typical foot liners, that treating the foot liner as a disposable one-use or limited-use foot liner would be technically feasible. While a preferred embodiment of the foot liner has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. For example, any suitable exterior material such as silk, nylon, rayon, or a variety of fabrics may be used instead of the flexible mesh exterior described. Also, the fastener may also be made of a drawstring to be tied rather than an elastic band. Furthermore, a wide variety of monolithic, layered, specially shaped, or other structures may be used instead of the bottom liner described.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A foot liner, suitable to be a foot-shaped insert positioned within the interior of a shoe, comprising:

a flexible mesh exterior containing deodorizer;

a fastener comprising a light-weight elastic band on the top surface of said flexible mesh exterior; and a bottom liner composed of absorbent paper-like cotton located in the bottom interior of said flexible mesh, wherein said bottom liner contains deodorizer, talc and medicated substance for athletes foot and provides a means for cushioning the foot.

* * * * *